US006691546B1

(12) United States Patent
Kovalik

(10) Patent No.: US 6,691,546 B1
(45) Date of Patent: Feb. 17, 2004

(54) RIVET NUT SETTING TOOL

(76) Inventor: Edward Kovalik, 2412 Red Oak Dr., Clarks Summit, PA (US) 18411

( * ) Notice: Subject to any disclaimer, the term of this patent is extended or adjusted under 35 U.S.C. 154(b) by 0 days.

(21) Appl. No.: 10/267,359

(22) Filed: Oct. 8, 2002

(51) Int. Cl.[7] ..... B21D 39/02; B21J 9/18

(52) U.S. Cl. ..... 72/391.4; 72/114; 72/391.6; 72/452.9; 29/432.2

(58) Field of Search ..... 72/114, 452.9, 72/391.4, 391.6; 29/432.2, 243.519

(56) References Cited

U.S. PATENT DOCUMENTS

| | | | | |
|---|---|---|---|---|
| 1,102,937 A | | 7/1914 | Malaby | |
| 2,428,165 A | | 9/1947 | Ketchum | |
| 2,483,112 A | | 9/1949 | Temple | |
| 3,256,730 A | | 6/1966 | Faull | |
| 3,396,572 A | | 8/1968 | Godsey | |
| 3,851,373 A | * | 12/1974 | Shinjo | 29/432.2 |
| 3,861,185 A | | 1/1975 | Maddox | |
| 3,933,019 A | | 1/1976 | Underland et al. | |
| 4,038,851 A | | 8/1977 | Coloma | |
| 4,086,799 A | | 5/1978 | Brendle | |
| 4,192,163 A | | 3/1980 | Martin | |
| 4,307,598 A | | 12/1981 | Andrich | |
| 4,425,782 A | | 1/1984 | Todisco | |
| 4,520,648 A | | 6/1985 | Gregory | |
| 5,299,442 A | | 4/1994 | Graham | |
| 5,329,694 A | * | 7/1994 | Sickels et al. | 29/243.519 |
| 5,515,710 A | * | 5/1996 | Larikka | 72/452.9 |
| 6,644,089 B1 | * | 11/2003 | Gorgen | 72/452.9 |

* cited by examiner

*Primary Examiner*—David Jones
(74) *Attorney, Agent, or Firm*—Mitchell A. Smolow

(57) ABSTRACT

The present invention includes both the device and the method for utilizing two wedge shaped halves to retract a stud used to deform rivet nut material, thereby setting the rivet nut. The tool consists of two wedge shaped halves and a stud passing through both halves, extending to receive the threads of an uncompressed rivet nut. A slide screw controls the wedging action, causing the stud to retract. A stabilizing member is utilized to resist the rotational forces created during activation of the slide screw. The slide screw allows the top wedge and bottom wedge to slidably relate to one another, allowing the stud to increasingly extend beyond the bottom wedge. The extended stud threads into a rivet nut which is then passed through a predrilled hole in the material to which the rivet nut is to be fastened. Upon activation, the slide screw causes the top wedge to slide along the bottom wedge. The wedging action decreases the length of the stud extending beyond the bottom piece, creating a withdrawal force that causes the compression area of the rivet nut to deform, setting the rivet nut in the material.

19 Claims, 4 Drawing Sheets

RIVET NUT SETTING TOOL

FIELD OF THE INVENTION

This invention relates to hand tools generally and in particular, to a rivet nut setting tool.

BACKGROUND OF THE INVENTION

A rivet nut is a term used to identify a type of blind fastener commonly used in the sheet metal industry. FIG. 1 shows a known rivet nut and FIG. 2 shows a known rivet nut after installation. The uncompressed rivet nut is in the shape of a cylinder with a flange at one end. The cylinder is threaded internally beginning at the non-flanged end. A non internally threaded compression area, fabricated from a deformable material, extends downward from the flange.

In use, the rivet nut is inserted through a pre-drilled hole in the sheet good until the flange prevents further passage. A threaded member, such as a rod or mandrel, is inserted through the flange to threadably engage the internal threads. An extracting force is applied to the threaded member, thereby causing the non-threaded compression area of the rivet nut to compress, forming a second flange on the opposite side of the sheet good, preventing removal of the rivet nut. Upon removal of the threaded member, the internal threads remain to accept a bolt or other threaded attachment.

A wide variety of blind fastener setting tools are known in the art. Some are very sophisticated and expensive, while other tools are very simple and inexpensive. Some, particularly those used in manufacturing operations, are wholly or semi automatic.

For example, U.S. Pat. No. 3,256,730 to Faull is directed to a device for forming an aperture in tubular stock. The device utilizes a wedged shaped sliding mechanism to extend a cutting tool to pierce the stock, and has the ability to vary both the size of the hole pierced in the tube stock and the size of the tube stock.

U.S. Pat. No. 3,396,572 to Godsey is directed to an angle attachment for a rivet gun. The device utilizes a wedge having an inclined surface in contact with a diagonal surface to alter the vector of force by 90 degrees when using a reciprocating rivet gun and bucking bar held against a rivet head to shape the rivet.

U.S. Pat. No. 5,329,694 to Sickels, et al. is directed to a method and apparatus to secure a self-attaching fastener, such as a pierce or clinch nut or stud to a metal wall of an enclosed structure, such as a tube, from inside the structure. An anvil assembly includes relatively movable parts having mating incline surfaces that are moved to expand or contract the anvil assembly. The body portion of a self-attaching fastener is inserted into an anvil pocket, the anvil is inserted into an enclosed structure, and the anvil is then expanded to locate or position the fastener adjacent to the inner surface of the wall of the enclosed structure. A die member then installs the nut in the wall, after which the anvil is contracted to remove the anvil from the structure. The die member installs the nut into the wall, piercing the wall of the enclosed structure and capturing the nut by deforming wall material of the enclosed structure into regions of the fastener that are designed to accept such deformed material. U.S. Pat. No. 3,933,019 to Underland, et al. is directed to a tool for installing an internally threaded tubular rivet. A pair of levers are pivotally connected together with one of the levers having a portion with a hole. A tubular anvil is received in the hole and secured to the lever. A rod extends axially through the anvil and is relatively movable with respect to the anvil. After threading a tubular rivet onto the rod, a relative movement between the two levers will affect a relative movement between the rod and the anvil, causing the deformation of the rivet material.

U.S. Pat. No. 4,425,782 to Todisco is directed to a tool for setting rivet nuts. The tool comprises a plurality of tubular handle powered pullers. One puller receives in its threaded bore a mandrel holder capable of readily receiving and holding a plurality of mandrels, each mandrel designed and sized to set a particular threaded rivet nut or rivet bolt. Utilizing the lever action of the handles, the handles are pressed towards one another to set the rivet.

U.S. Pat. No. 5,299,442 to Graham is directed to an apparatus for installing threaded rivet nuts. The apparatus comprises a frame and a carriage mounted slidably on the frame. The frame has a work support part and the carriage is equipped with a fastener, the threaded end of which extends through a hole in the work support part. A jack is situated between one member attached to the frame and another on the carriage. Extension of the jack moves the carriage on the frame to retract the fastener part way into the hole in the work support part. Tension springs serve to restore the carriage to its at rest position relative to the frame when the jack is not extended. A threaded rivet nut is threaded onto the fastener, the shank of the rivet nut is inserted through a hole in the work piece, and the jack is extended to collapse the rivet nut shank.

U.S. Pat. No. 3,861,185 to Maddox is directed to a hand tool for the upsetting of a threaded rivet nut. The tool has a stationary held body member with a smooth bore extending there through to receive an elongated longitudinal movable member. The elongated member has its opposite ends threaded with one end adapted to receive the threaded rivet nut for upsetting while the other threaded end receives a nut for rotation relative to the stationary held body member. Rotation of the nut causes an axial force which causes deformation of the threaded rivet nut material.

While the Faull, Godsey and Sickels et al. patents all disclose hand tool utilizing wedging mechanisms, none are suited for compressing rivet nuts. The Faull patent is used for piercing, the Godsey patent is used for hammering, and the Sickels et al. patent is used for inserting. Other similar hand tools utilize a wedge mechanism to transmit forces to a work piece in a direction substantially perpendicular to application of the force. However, none of the prior art are directed to compressing rivet nuts, rather, they are directed to utilizing the work principal for a different specific application.

The Underland, Todisco, Graham and Maddox patents are all directed to hand tools utilized in collapsing and setting threaded rivet nuts. None of those patents utilize a wedging mechanism. The Underland and Todisco patents both utilize the levering of a pair of handles to withdraw a rod effectuating the deformation of the rivet nut material. The Graham patent utilizes a jack mechanism, while the Maddox patent utilizes an in-line threading mechanism to create axial movement of a rod or shank to effectuate deformation of the rivet nut material.

Accordingly, there remains a need for improved methods and devices to apply rivet nut setting forces. The present invention fulfills this need, and further provides related advantages.

BRIEF SUMMARY OF THE INVENTION

The present invention includes both the device and the method utilizing two wedge shaped halves to retract a stud used to deform rivet nut material, thereby setting the rivet nut.

The tool consists of two wedge shaped halves and a stud passing through both halves, extending to receive the threads of an uncompressed rivet nut. A slide screw controls the wedging action, causing the stud to retract. A stabilizing rod passing transversely through the bottom wedge is utilized to resist the rotational forces created during activation of the slide screw.

The slide screw allows the top wedge and bottom wedge to slidably relate to one another, allowing the stud to increasingly extend beyond the bottom wedge. The extended stud threads into a rivet nut which is then passed through a predrilled hole in the material to which the rivet nut is to be fastened. Upon activation, the slide screw causes the top wedge to slide along the bottom wedge. The wedging action decreases the length of the stud extending beyond the bottom piece, creating a withdrawal force that causes the compression area of the rivet nut to deform, setting the rivet nut in the material.

One advantage of the present invention is the ability to conveniently and inexpensively accommodate rivet nuts of differing internal thread size.

Another advantage of the present invention is the ability to quickly, simply, and inexpensively set a rivet nut.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
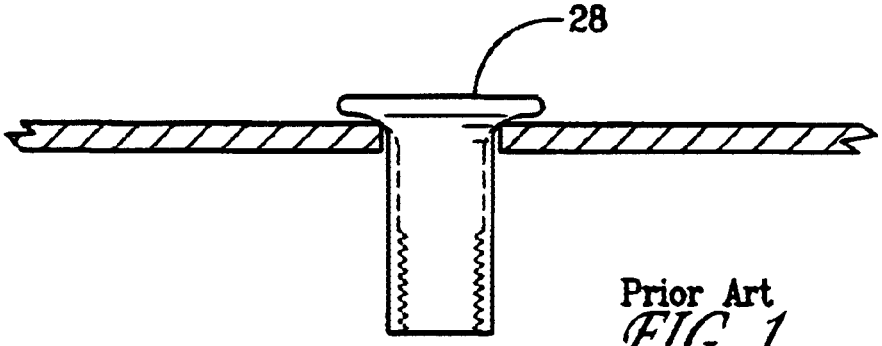
Prior Art FIG. 1
FIG. 1 is a side view of a known rivet nut before installation.
Figure 2:
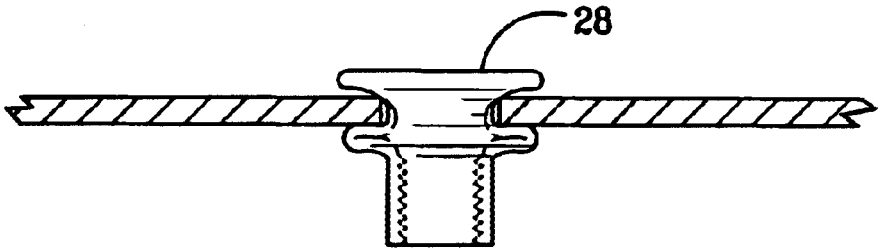
Prior Art FIG. 2
FIG. 2 is a side view of a known deformed rivet nut after installation.
Figure 3:
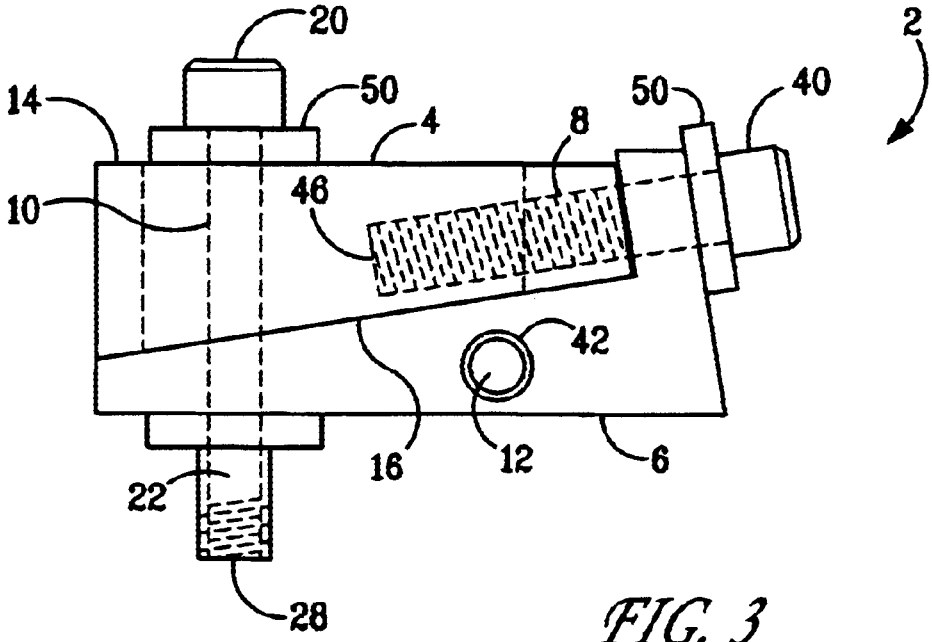
FIG. 3 is a side view of the rivet nut setting tool of the present invention.
Figure 4:
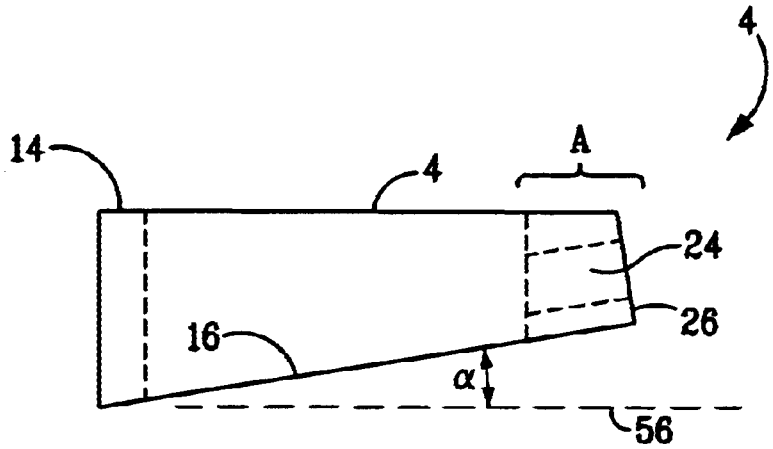
FIG. 4 is a side view of the ramp.
Figure 5:
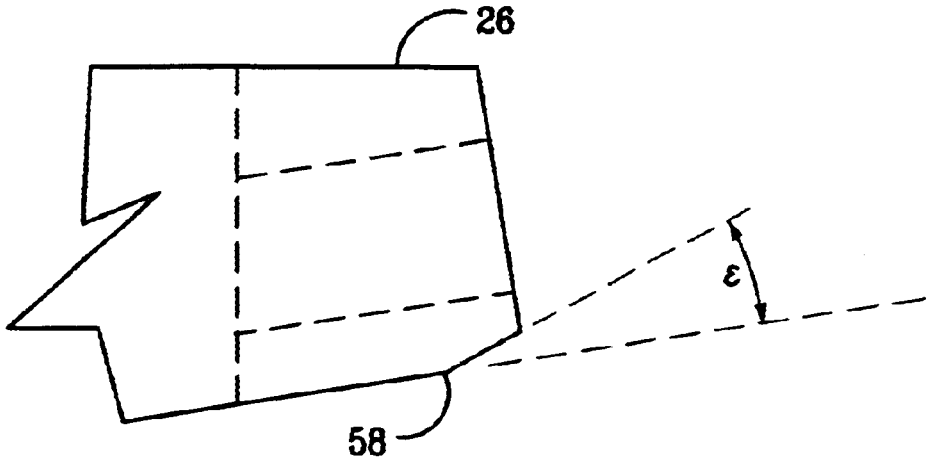
FIG. 5 is detail A of FIG. 4.
Figure 6:
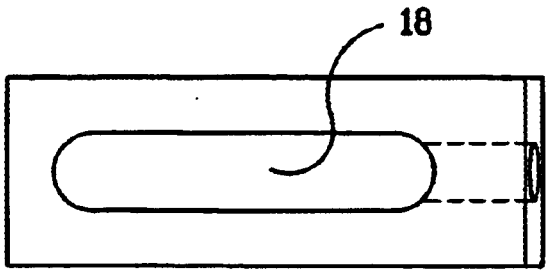
FIG. 6 is a top view of the ramp.
Figure 7:
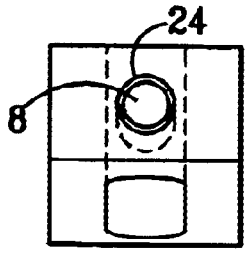
FIG. 7 is an end view of the ramp.

Referring to FIG. 3, rivet nut setting tool 2 comprises ramp 4, slide 6, slide screw 8, stud 10, and an anti-rotational member, for example a stabilizing rod 12. The component parts are preferably fabricated from a substantially rigid, preferably lightweight material, for example, metal such as die cast, extruded, or rolled aluminum, aluminum alloy and stainless steel; molded plastic; layed up laminate plastic; wood and combinations thereof.

Referring to FIGS. 3 through 7, angle a, formed by ramp bottom surface 16 and horizontal plane 56 is an acute angle. Preferably, angle a is about 5 degrees to about 15 degrees, and most preferably, about 10 degrees. Slot 18 for stopably receiving stud 10 is fabricated into ramp 4 passing from top surface 14 to bottom surface 16 such that stud first end 20 is prevented from passing through ramp top surface 14 while stud second end 22 extends beyond slide bottom surface 16 to engage rivet nut 28. After assembly of the rivet nut setting tool 2, stud second end 22 extends at an angle substantially perpendicular to slide bottom surface 32.

Threaded hole 24 for engaging threaded slide screw 8 is machined into ramp small end 26 such that the centerline of threaded hole 24 is substantially parallel to ramp bottom surface 16. When threadably engaged, slide screw 8 is substantially perpendicular to ramp small end 26. Optionally, ramp small end 26 is beveled 58 to allow smoother travel of ramp 4 along slide 6. In a preferred embodiment, bevel angle $\epsilon$ is about 5 degrees to about 15 degrees, preferably about 10 degrees.

Figure 8:
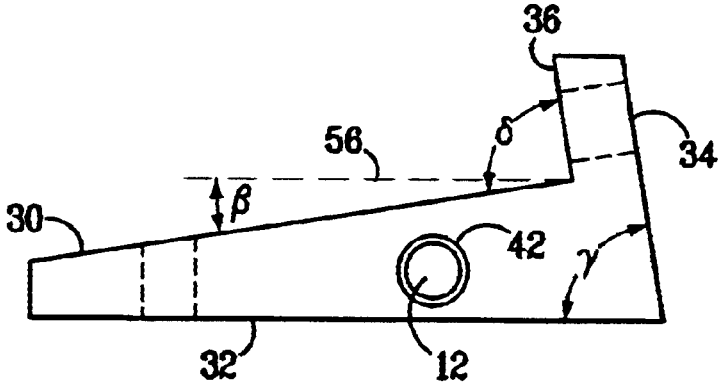
FIG. 8 is a side view of the slide.
Figure 9:
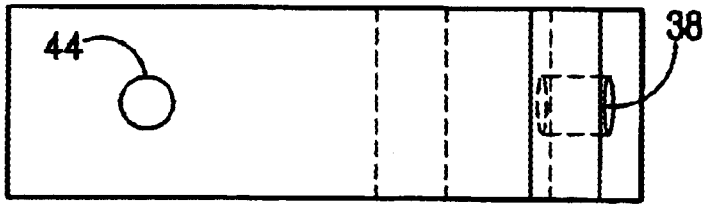
FIG. 9 is a top view of the slide.
Figure 10:
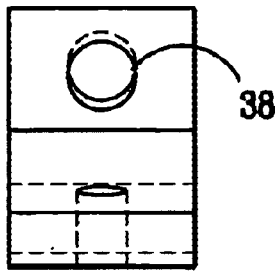
FIG. 10 is an end view of the slide.

Additionally referring to FIGS. 8 through 10, angle $\beta$, formed by slide top surface 30 and horizontal plane 56 is an acute angle. Preferably, angle $\beta$ is about 5 degrees to about 15 degrees, and most preferably, about 10 degrees. Angle $\beta$ and angle $\alpha$ are paired such that when ramp bottom surface 16 is mated with slide top surface 30, ramp top surface 14 and slide bottom surface 32 are substantially parallel.

Optionally, in a preferred embodiment, angle $\gamma$ formed by slide bottom surface 32 and slide large end extension 34 and angle $\delta$ formed by slide top surface 30 and slide large end extension 34 are both acute angles. Large end interior surface 36 provides a positive stop for ramp small end 26.

Slide large end extension 34 contains first bore hole 38 positioned such that slide screw 8 passing through first bore hole 38 engages ramp threaded hole 24 as ramp 4 rests on slide 6. Because ramp small end 26 is substantially parallel to slide large end 34 when assembled for use, slide screw 8 passes through slide large end extension 34 at a substantially perpendicular angle, thereby allowing first end 40 of slide screw 8 to stopably engage slide large end extension 34.

Second bore hole 42 is positioned in slide 6 such that when stabilizing rod 12 is passed through second bore hole 42, stabilizing rod 12 rests substantially perpendicular to slot 18. Inserted stabilizing rod 12 extends on either side, preferably on both sides, of assembled rivet nut setting tool 2. Third bore hole 44 is positioned in slide 6 to receive stud 10 after stud 10 passes through slot 18, allowing stud 10 to extend beyond slide bottom surface 32.

Slide screw first end 40 is fabricated to stopably rest against slide large end 34. Slide screw second end 46 is threaded to threadably engage ramp threaded hole 24. In a preferred embodiment, slide screw 8 is a bolt, for example, a ¼-20×1¾ inch hex head cap screw. Likewise, stud first end 20 is fabricated to rest against ramp slot 18 and stud second end 22 is threaded to threadably engage rivet nut 28. In a preferred embodiment, stud 10 is a bolt, for example, a ¼-20×1½ inch hex head cap screw. Optional washers 50 may be utilized with slide screw 8 and stud 10.

Figure 11:
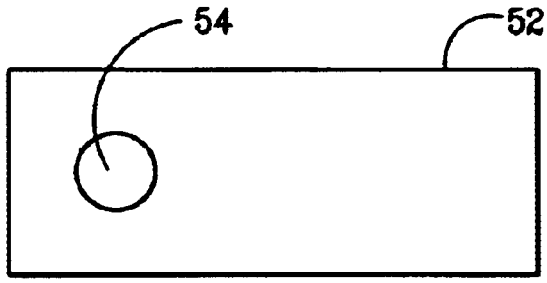
FIG. 11 is a top view of the spacer.

Referring to FIG. 11, optional spacer 52 is placed between ramp 4 and slide 6. Spacer contains fourth bore hole 54 to permit passage of stud 10.

Figure 12:
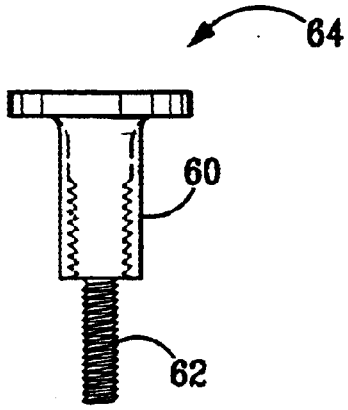
FIG. 12 is a side view of the bushing.

Rivet nuts 28 of varying diameter are accommodated by utilizing studs 10 appropriately sized for the rivet nut 28 in use. Alternatively, internally threaded bushing first end 60 of bushing 64, shown in FIG. 12, is threaded onto stud 10. Threaded bushing second end 62 is sized in diameter to accept a given rivet nut diameter.

In use, the present invention operates as follows:

Tool 2 is assembled by mating ramp 4 to slide 6, placing optional spacer 52 between them. Slide screw 8 is passed through first bore hole 38 to engage ramp 4. Stud 10 is passed through slot 18, optional fourth bore hole 54 if present, and third bore hole 44.

Slide 6 is completely retracted and rivet nut 28 is engaged finger tight on stud 10. Stabilizing rod 12 is positioned in second bore hole 42. The rivet nut 28 is inserted into a preformed hole of predetermined diameter sized to accept the rivet nut 28 without "play". Slide screw 8 is tightened to draw slide 6 up ramp 4, thereby creating a retracting force on stud 10. Stabilizing rod 12 is grasped and used to counteract rotational force applied to tighten slide screw 8.

After rivet nut 28 deforms and "seats" itself, slide screw 8 is backed out a few turns and slide 6 is "tapped" back slightly. Stud 10 is unthreaded from rivet nut 28, thereby disengaging tool 2, leaving rivet nut 28 securely fastened.

While the above description contains many specifics, these should not be construed as limitation on the scope of the invention, but rather as an exemplification of preferred embodiments thereof. It should be apparent to those skilled in the art that many other variations are possible. For example, although the stabilizing rod is used to counteract the rotational force placed on the slide screw, it is possible to use the tool without insertion of the rod. Furthermore, other anti-rotational extensions, such as wings molded into the slide may be utilized.

Additionally, it should be understood that hex head cap screws have been used as exemplars, these and other fastening devices, such as quick release devices, allowing for ease of hand tightening may be utilized for both the slide screw and stud.

These examples and embodiments are intended as typical of, rather than in any way limiting on, the scope of the present invention as presented in the appended claims.

What is claimed is:

1. A rivet nut setting tool comprising:

a wedge shaped ramp having a slot passing from a top surface to a bottom surface for through passage of a stud and a threaded hole at a small end of the wedge shaped ramp for threadably receiving a slide screw;

a wedge shaped slide having a first bore hole in a large end extension for through passage of the slide screw, a third bore hole for through passage of a stud second end for receiving the rivet nut, and an anti-rotational member for counteracting a rotational activation force placed on the slide screw;

wherein a stud first end prevents complete through passage of the stud through the slot, a slide screw first end prevents complete through passage of the slide screw through the first bore hole, and the wedge shaped ramp and the wedge shaped slide are positioned relative to one another such that upon application of the rotational activation force, the ramp slides along the slide causing the stud second end to retract.

2. The rivet nut setting tool of claim 1 further comprising a spacer placed between the wedge shaped ramp and the wedge shaped slide, the spacer including a fourth bore hole for through passage of the stud.

3. The rivet nut setting tool of claim 1 wherein the anti-rotational member comprises a second bore hole in the wedge shaped slide and a stabilizing rod received by the second bore hole.

4. The rivet nut setting tool of claim 3 wherein the stabilizing rod is received by the second bore hole substantially perpendicular to the slot.

5. The rivet nut setting tool of claim 1 wherein a first angle formed by a ramp bottom surface and a horizontal plane and a second angle formed by a slide top surface and the horizontal plane are both acute angles, a centerline of the threaded hole is substantially parallel to the ramp bottom surface, and the stud second end extends at an angle substantially perpendicular to a slide bottom surface.

6. The rivet nut setting tool of claim 1 wherein the small end of the wedge shaped ramp is beveled an effective amount to allow smoother travel of the wedge shaped ramp along the wedge shaped slide.

7. The rivet nut setting tool of claim 1 wherein a first angle formed by a ramp bottom surface and a horizontal plane and a second angle formed by a slide top surface and the horizontal plane are both about ten degrees.

8. The rivet nut setting tool of claim 1 wherein the wedge shaped ramp top surface and the wedge shaped slide bottom surface are substantially parallel after assembly.

9. The rivet nut setting tool of claim 1 wherein a first angle formed by the wedge shaped slide bottom surface and the large end extension and a second angle formed by the wedge shaped slide top surface and the large end extension are both acute angles.

10. The rivet nut setting tool of claim 1 wherein the slide screw and the stud are both hex head cap screws.

11. The rivet nut setting tool of claim 1 further comprising a bushing wherein a bushing first end is removably attached to the stud second end and a bushing second end is sized in diameter to accept a predetermined rivet nut diameter.

12. A rivet nut setting tool comprising:

a wedge shaped ramp having a slot passing from a top surface to a bottom surface for through passage of a stud and a threaded hole at a small end of the wedge shaped ramp for threadably receiving a slide screw;

a wedge shaped slide having a first bore hole in a large end extension for through passage of the slide screw, a third bore hole for through passage of a stud second end for receiving the rivet nut, and a second bore hole in the wedge shaped slide for receiving a stabilizing rod for counteracting a rotational activation force placed on the slide screw, the stabilizing rod passing through the second bore hole substantially perpendicular to the slot;

wherein a stud first end prevents complete through passage through the slot, a slide screw first end prevents complete through passage through the first bore hole, and the wedge shaped ramp and the wedge shaped slide are positioned relative to one another such that upon application of the rotational activation force, the ramp slides along the slide causing the stud second end to retract.

13. The rivet nut setting tool of claim 12 further comprising a bushing wherein a bushing first end is removably attached to the stud second end and a bushing second end is sized in diameter to accept a predetermined rivet nut diameter.

14. A method for setting a rivet nut comprising the steps of:

attaching a rivet nut to a tool;

inserting the rivet nut into a hole appropriately sized to receive the rivet nut;

activating the tool, thereby deforming the rivet nut; and disengaging the tool from the rivet nut;

wherein tool comprises a wedge shaped ramp having a slot passing from a top surface to a bottom surface for through passage of a stud and a threaded hole at a small end of the wedge shaped ramp for threadably receiving a slide screw;

a wedge shaped slide having a first bore hole in a large end extension for through passage of the slide screw, a third bore hole for through passage of a stud second end for receiving the rivet nut, and an anti-rotational member for counteracting a rotational activation force placed on the slide screw;

wherein a stud first end prevents complete through passage through the slot, a slide screw first end prevents complete through passage through the first bore hole, and the wedge shaped ramp and the wedge shaped slide are positioned relative to one another such that upon application of the rotational activation force, the ramp slides along the slide causing the stud second end to retract.

15. The method of claim 14 wherein the anti-rotational member comprises a second bore hole in the wedge shaped slide for receiving a stabilizing rod.

16. The method of claim 15 wherein the stabilizing rod passes through the second bore hole substantially perpendicular to the slot.

17. The method of claim 14 wherein a first angle formed by a ramp bottom surface and a horizontal plane and a second angle formed by a slide top surface and the horizontal plane are acute angles, a centerline of the threaded hole is substantially parallel to the ramp bottom surface, and the stud second end extends substantially perpendicular to a slide bottom surface.

18. The method of claim 14 wherein the small end of the wedge shaped ramp is beveled an effective amount to allow smoother travel of the wedge shaped ramp along the wedge shaped slide.

19. A rivet nut produced by the method of claim 14.

* * * * *